US010190584B2

(12) United States Patent
Yoon

(10) Patent No.: US 10,190,584 B2
(45) Date of Patent: Jan. 29, 2019

(54) ELECTRIC PUMP

(71) Applicant: LG INNOTEK CO., LTD., Seoul (KR)

(72) Inventor: Ho Eop Yoon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 782 days.

(21) Appl. No.: 14/629,759

(22) Filed: Feb. 24, 2015

(65) Prior Publication Data

US 2015/0240811 A1 Aug. 27, 2015

(30) Foreign Application Priority Data

Feb. 25, 2014 (KR) ..... 10-2014-0021926

(51) Int. Cl.
*F04C 11/00* (2006.01)
*F04C 2/10* (2006.01)
*F04C 15/00* (2006.01)

(52) U.S. Cl.
CPC ..... *F04C 11/001* (2013.01); *F04C 2/102* (2013.01); *F04C 15/0061* (2013.01); *F04C 2210/206* (2013.01)

(58) Field of Classification Search
CPC ..... F04C 2/102; F04C 11/001; F04B 17/03; F04D 13/0613; F04D 17/122
See application file for complete search history.

(56) References Cited

U.S. PATENT DOCUMENTS 6,679,692 B1 1/2004 Feuling
2001/0026767 A1 10/2001 Takagi et al.
2002/0131873 A1* 9/2002 Staton ..... F04C 11/008 417/310
2003/0012664 A1 1/2003 Maier et al.
2004/0101427 A1* 5/2004 Yu ..... F04C 2/102 418/15

(Continued)

FOREIGN PATENT DOCUMENTS

CN 201827069 U 5/2011
CN 202250810 U 5/2012

(Continued)

OTHER PUBLICATIONS

Kumamoto, WO 2013/172410, Nov. 2013, 14629759_Sep. 21, 2017_WO_2013172410_A1_I_MachTrans.*

(Continued)

*Primary Examiner* — Kenneth J Hansen
(74) *Attorney, Agent, or Firm* — Ked & Associates, LLP

(57) ABSTRACT

An electric pump includes a motor unit including a stator, a rotor core disposed inside the stator and a shaft coupled to the rotor core; a first pump unit and a second pump unit which are coupled using the shaft as a coaxial axis; a first housing in which a motor housing receiving the motor unit and a pump housing including a first pump accommodating part are integrally formed, the first pump unit being inserted in the first pump accommodating part; a second housing coupled to the first housing to cover the first pump accommodating part and including a second pump accommodating part in which the second pump unit is inserted; and a cover unit coupled to the second housing to cover the second pump accommodating part.

4 Claims, 8 Drawing Sheets

(56) References Cited

U.S. PATENT DOCUMENTS

| | | | | |
|---|---|---|---|---|
| 2012/0251354 | A1 | 10/2012 | Kogure | |
| 2013/0202464 | A1* | 8/2013 | Miyaki | F01C 21/10<br>417/410.4 |

FOREIGN PATENT DOCUMENTS

| | | | | |
|---|---|---|---|---|
| CN | 102734447 | | 10/2012 | |
| CN | 103244408 | | 8/2013 | |
| EP | 1 443 210 | A2 | 8/2004 | |
| EP | 1 598 556 | | 11/2005 | |
| EP | 1 908 956 | A1 | 4/2008 | |
| JP | S59-29788 | A | 2/1984 | |
| WO | WO 91/16537 | A1 | 10/1991 | |
| WO | WO 2006/071003 | | 7/2006 | |
| WO | WO 2013172410 | * | 11/2013 | F04C 11/00 |

OTHER PUBLICATIONS

European Search Report dated Sep. 14, 2015 issued in Application No. 15156461.4.
Chinese Office Action dated Dec. 14, 2017 issued in Application No. 201510087799.7 (with English translation).
European Patent Office Communication dated Apr. 26, 2018 issued in Application No. 15156461.4.

* cited by examiner

ELECTRIC PUMP

CROSS-REFERENCE TO RELATED APPLICATION

This application claims priority under 35 U.S.C. § 119 to Korean Application No. 10-2014-0021926 filed on Feb. 25, 2014, whose entire disclosure is hereby incorporated by reference.

BACKGROUND

1. Field

The present disclosure relates to an electric pump, and more particularly, to an electric pump pumping a fluid through a rotor rotated by a motor.

2. Background

In general, electric oil pumps (EOP) are devices for supplying, using a motor, oil to an oil pressure line in a transmission or a braking device of a vehicle in which an oil circulation is required.

In the case of hybrid electric vehicles (HEVs), since an engine is halted when a vehicle is not travelled, it is difficult to supply a predetermined pressure to a transmission through a mechanical oil pump. Due to this, an electric oil pump which supplies oil through a motor is used in the HEVs.

In the case of such an electric oil pump, a pump, a motor, and an inverter are separately manufactured, the pump and the motor are fastened by bolts, and the inverter is connected to the motor and the pump by means of separate cables. Therefore, the existing electric oil pumps are disadvantageous in that there are many wasteful factors in terms of a performance, efficiency and a manufacturing cost.

Meanwhile, in order to improve fuel efficiency of a vehicle, a two-stage electric pump composed of a pump supplying low-pressure fluid and a pump supplying high-pressure fluid has been proposed to minimize power which may be necessarily consumed. At this time, each pump in the above two-stage pump is completely separated from the motor, the number of components is increased, a volume of the electric pump and a manufacturing cost are increased.

BRIEF DESCRIPTION OF THE DRAWINGS

The embodiments will be described in detail with reference to the following drawings in which like reference numerals refer to like elements wherein.

DETAILED DESCRIPTION

Hereinafter, exemplary embodiments of the present disclosure will be described in detail with reference to the accompanying drawings. Objects, specific advantages and novel characteristics of the present disclosures will be more clearly understood from the following description and the preferred embodiments taken in conjunction with the accompanying drawings. And, the vocabularies or terminologies used in the detail description and claims shall not be interpreted as being limited to having a common or dictionary meaning, and shall be interpreted as having a meaning and concept suitable for the technical spirit of the present disclosure on the basis of the principle that the inventor can define a concept the terminology by himself/herself in order to describe his/her disclosure in the best manner. In the detail description describing the present disclosure, in addition, the description on the related well-known technologies which would unnecessarily obscure the gist of present disclosure will be omitted.

The terms including the ordinal numeral such as "first", "second", etc. may be used to describe various components, but the components are not limited by such terms. The terms are used only for the purpose of distinguishing one component from other components. For example, the second component may be designated as the first component without departing from the scope of the present disclosure. In the same manner, the first component may be designated as the second component. The term "and/or" encompasses both combinations of the plurality of related items disclosed and any item from among the plurality of related items disclosed.

The present disclosure is configured to supply low-pressure oil and high-pressure oil to sites at which the low-pressure oil and the high-pressure oil are required, respectively, through a low-pressure pump and a high-pressure pump so that power consumption of the electric pump is reduced and a configuration is simplified to reduce a dimension of the electric pump and a manufacturing cost.

Figure 1:
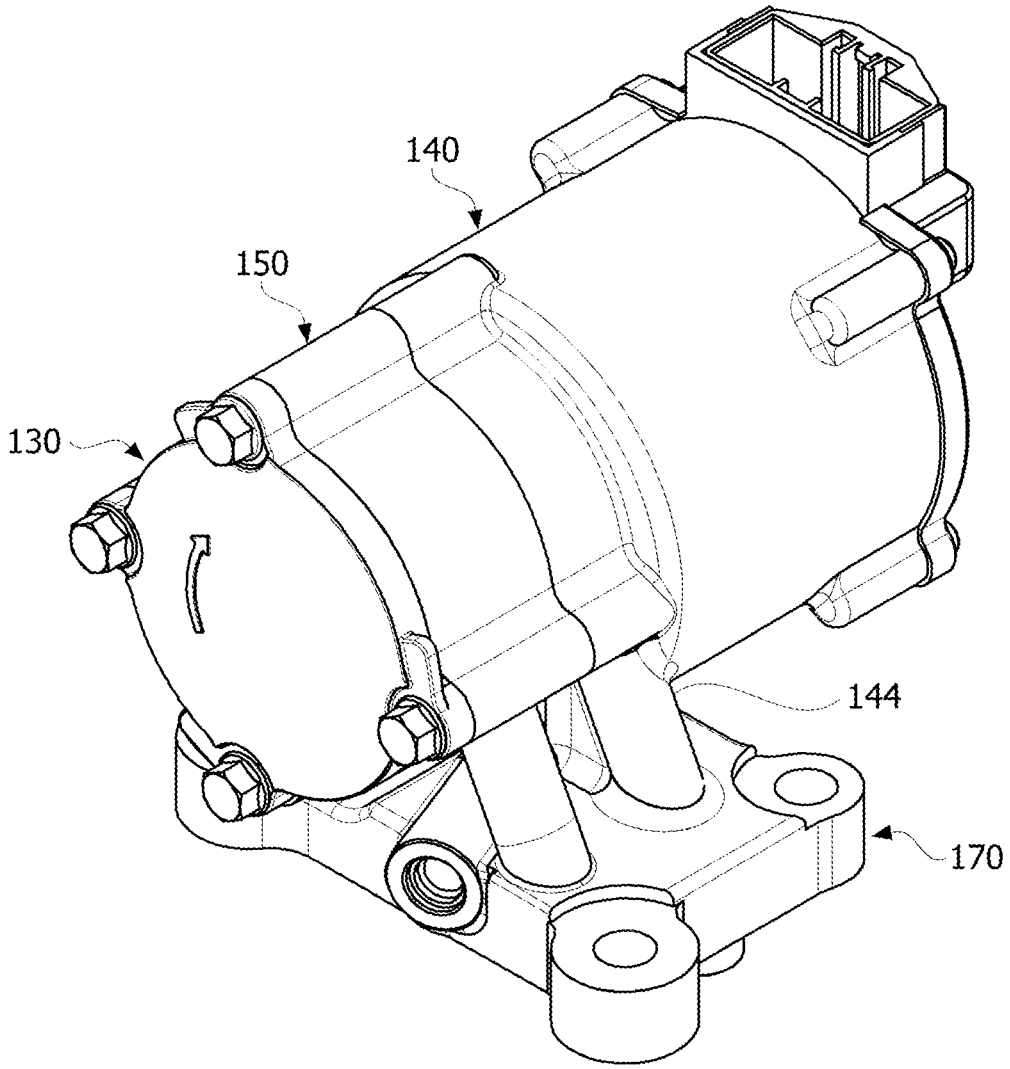
FIG. 1 is a view showing an electric pump according to one preferred embodiment of the present disclosure.
Figure 2:
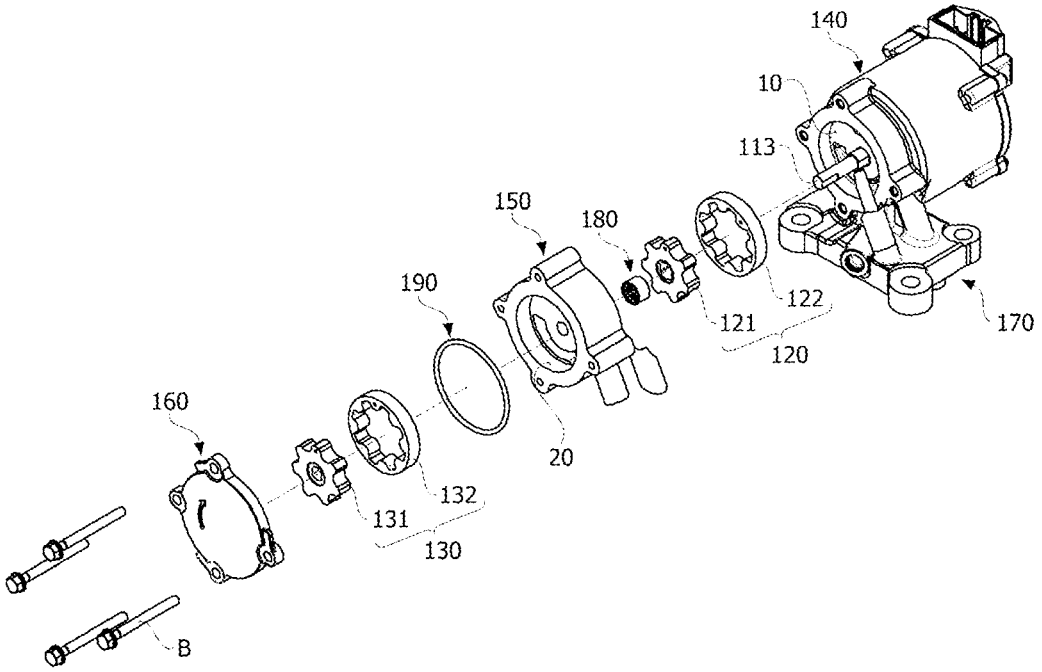
FIG. 2 is an exploded perspective view of an electric pump shown in FIG. 1.
Figure 3:
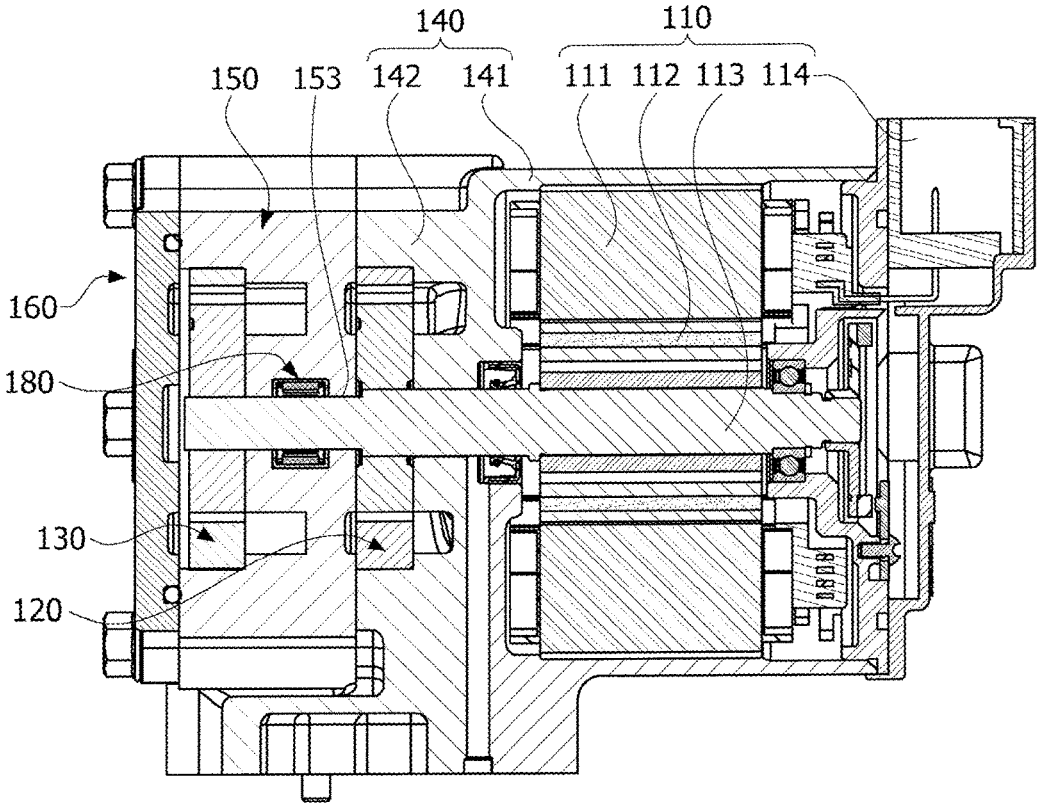
FIG. 3 is a cross-sectional view of an electric pump shown in FIG. 1.

FIG. 1 is a view showing an electric pump according to one preferred embodiment of the present disclosure, FIG. 2 is an exploded perspective view of the electric pump shown in FIG. 1 and FIG. 3 is a cross-sectional view of the electric pump shown in FIG. 1. FIG. 1 to FIG. 3 clearly show the main characterized parts of the present disclosure in order to conceptually and clearly understand the present disclosure. As a result, various modifications of the drawings are expected, and there is no need to limit a scope of the present disclosure to the specific shape shown in the drawings.

Referring to FIG. 1 to FIG. 3 together, an electric pump according to one preferred embodiment of the present disclosure may include a motor unit 110, a first pump unit 120, a second pump unit 130, a first housing 140, a second housing 150 and a cover unit 160.

The motor unit 110 provides the pump unit 120 with power and may include a stator 111, a rotor core 112, and a shaft 113.

The stator 111 may be installed along a circumference of the rotor core 112 with a gap formed therebetween. In addition, a coil generating a rotating magnetic field is wound around the stator 111 and induces an electrical interaction with the rotor core 112, thereby causing rotation of the rotor core 112. Once the rotor core 112 is rotated, the first pump unit 120 and the second pump unit 130 are provided with power while the shaft 113 is rotated. At this time, the shaft 113 may be configured to allow an end portion of the shaft to extend into a second pump accommodating part 20 of the second housing 150.

Meanwhile, the motor unit 110 may include an inverter and an inverter driving part. Also, a print circuit board mounted in the inverter may be directly connected to three-phase (U, V, W) terminals.

The first pump unit 120 and the second pump unit 130 may be configured to be rotated using one shaft 113 as a coaxial axis.

First, the first pump unit 120 is inserted into a first pump accommodating part 10 formed in the first housing 140 and the second pump unit 130 is inserted into the second pump accommodating part 20 formed in the second housing 150 so that power is transmitted from the motor unit 110 to each pump unit to allow each pump unit to pump oil. Here, the function of the first pump unit 120 is to pump low-pressure oil to a site at which the low-pressure oil is required and the second pump unit 130 may pump the high-pressure oil to a site at which the high-pressure oil is required.

Figure 4:
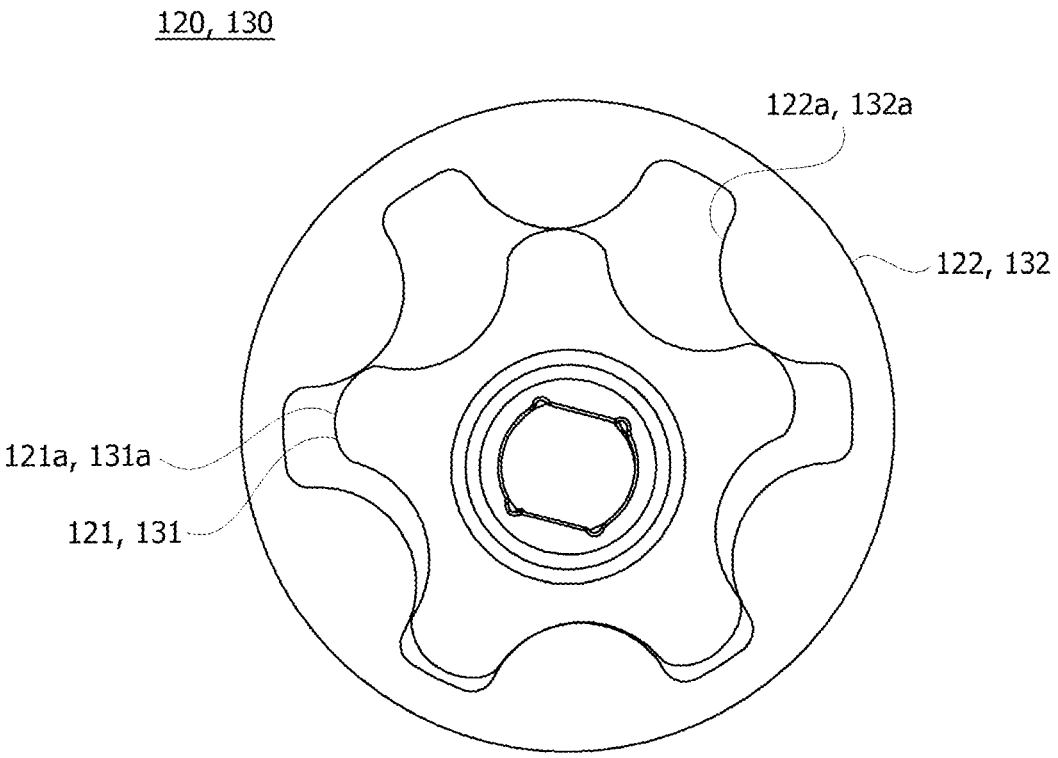
FIG. 4 is a view showing external rotors and internal rotors of a first pump unit and a second pump unit.

FIG. 4 is a view showing external rotors and internal rotors of the first pump unit and the second pump unit.

Referring to FIG. 4, the first pump unit 120 and the second pump unit 130 may include internal rotors 121 and 131 and external rotors 122 and 132, respectively. The shaft 113 is fixedly inserted into central portions of the internal rotors 121 and 131 to directly transmit the power from the motor unit 110 to the internal rotors.

The external rotors 122 and 132 are disposed outside the internal rotors 121 and 131. In addition, N external lobs 121*a* and 131*a* may be formed in the circumferential direction of the internal rotors, and each of the external lobs extends outward in the radial direction in the internal rotor with respect to a rotational center of the internal rotor. Meanwhile, N+1 internal lobs 122*a* and 132*a* may be formed in the external rotors 122 and 132, and each of the internal lobs extends inward in the radial direction in the external rotor. At this time, the first pump unit and the second pump unit may be configured to allow the external lobs 121*a* and 131*a* to be engaged with the internal lobs 122*a* and 132*a*. According to rotation of the internal rotors 121 and 131, the external rotors 122 and 132 are rotated at a speed ratio of (N+1)/N.

When the internal rotors 121 and 131 are rotated, the first pump unit 120 and the second pump unit 130 have a predetermined eccentric configuration, and spaces through which the oil may be conveyed are formed between the internal rotor 121 and the external rotor 122 and between the internal rotor 131 and the external rotor 132 due to the above eccentric configuration. In other words, when the internal rotors 121 and 131 are rotated, a portion whose volume is increased sucks the ambient oil due to pressure drop and a portion whose volume is decreased discharges the oil due to a pressure increase. Meanwhile, the pump structure shown in FIG. 4 exemplarily describes one embodiment of the present disclosure, and the present disclosure is not limited thereto.

The first housing 140 may include a motor housing 141 (see FIG. 3) receiving the motor unit 110 and a pump housing 142 (FIG. 3) receiving the first pump accommodating part 10. At this time, the motor housing 141 may be integrally formed with the pump housing 142. In addition, a mounting part 170 may be integrally formed with the motor housing 141 and the pump housing 142.

Figure 5:
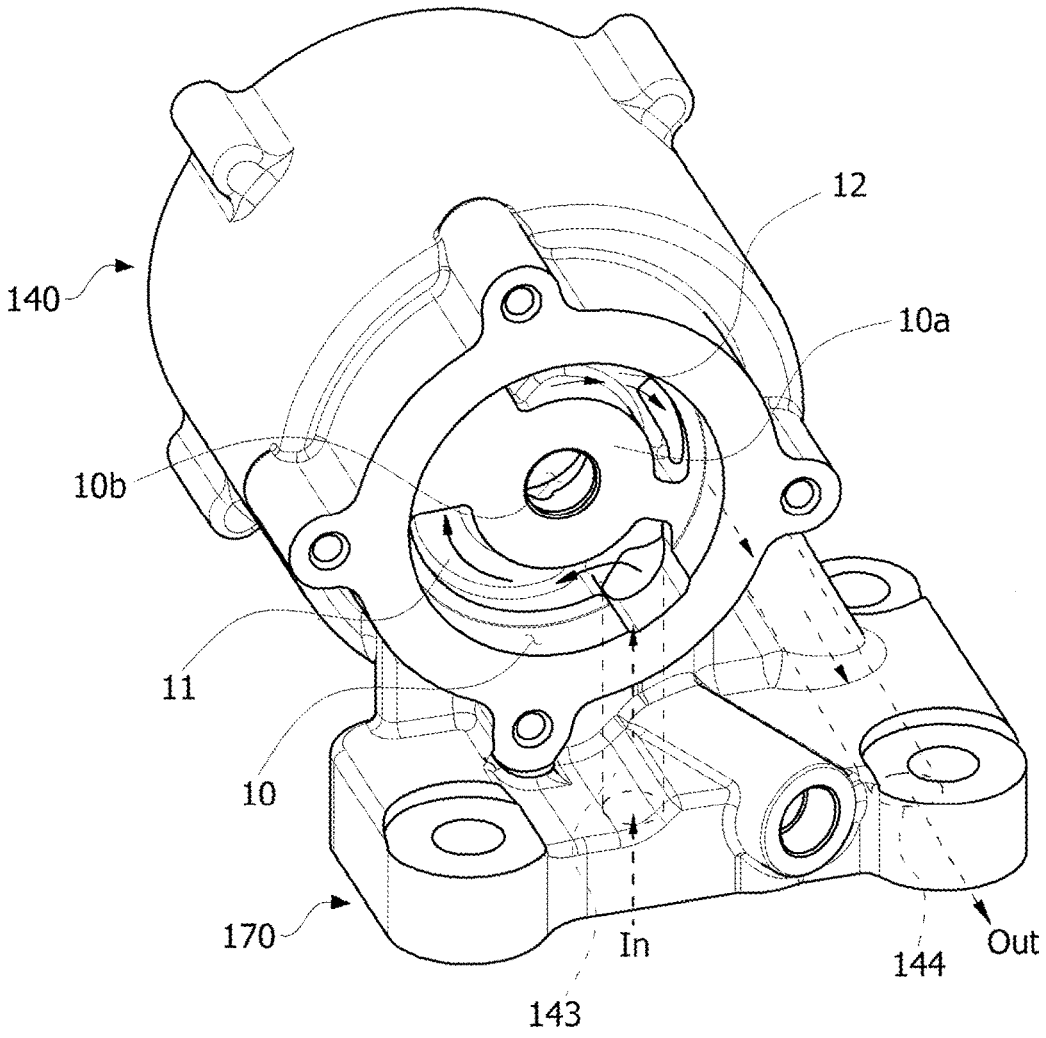
FIG. 5 is a view showing a first-stage inlet channel and a first-stage outlet channel of a first housing.

FIG. 5 is a view showing a first-stage inlet channel and a first-stage outlet channel of the first housing.

Referring to FIG. 5, a first-stage inlet port 11 and a first-stage outlet port 12 may be formed in a bottom face of the first pump accommodating part 10. The first-stage inlet port 11 and the first-stage outlet port 12 may be separated from each other to prevent a flow of a fluid caused by a pressure difference. In addition, a shaft hole 10*b* through which the shaft 113 passes may be formed at a center of the bottom face of the first pump accommodating part 10.

Here, the first-stage inlet port 11 is connected to a first-stage inlet channel 143. Also, the first-stage outlet port 12 is connected to a first-stage outlet channel 144. An entrance of the first-stage inlet channel 143 may be formed in a bottom face of the mounting part 170 and an exit of the first-stage inlet channel may be formed at an end portion of the first-stage inlet port 11. In addition, an entrance of the first-stage outlet channel 144 may be formed at an end portion of the outlet port 12 and an exit of the first-stage outlet channel may be formed in the bottom face of the mounting part 170. However, the present disclosure is not limited to the above structure, but may be variously modified and realized according to coupling positions on a transmission of a vehicle.

Figure 6:
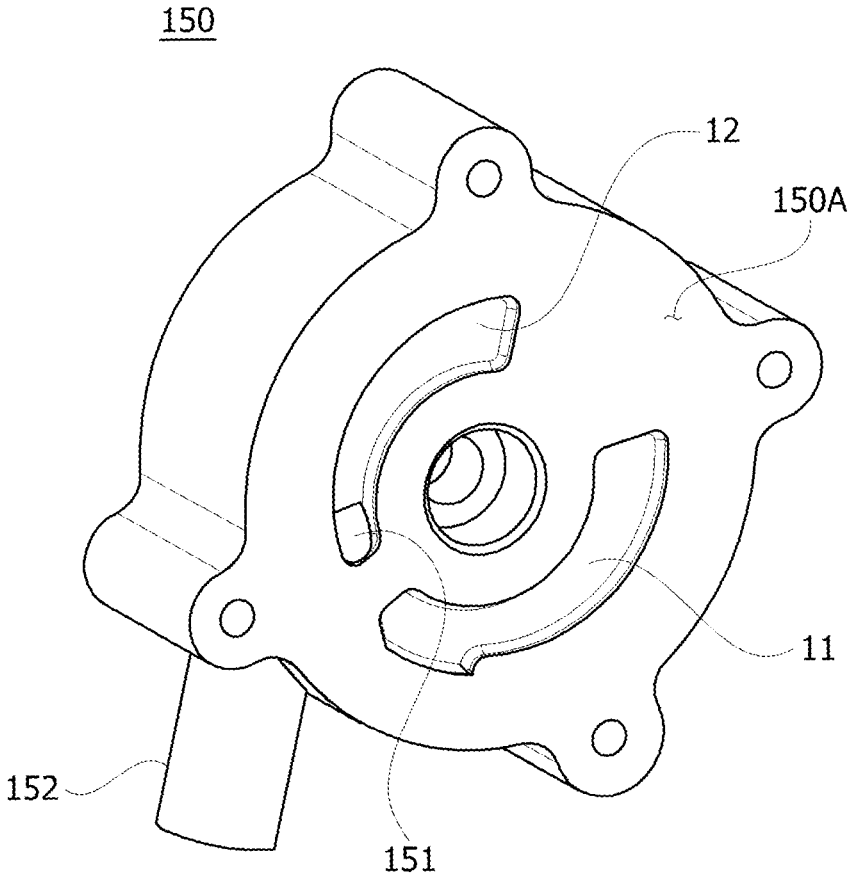
FIG. 6 is a view showing a second-stage inlet channel of a second housing.
Figure 7:
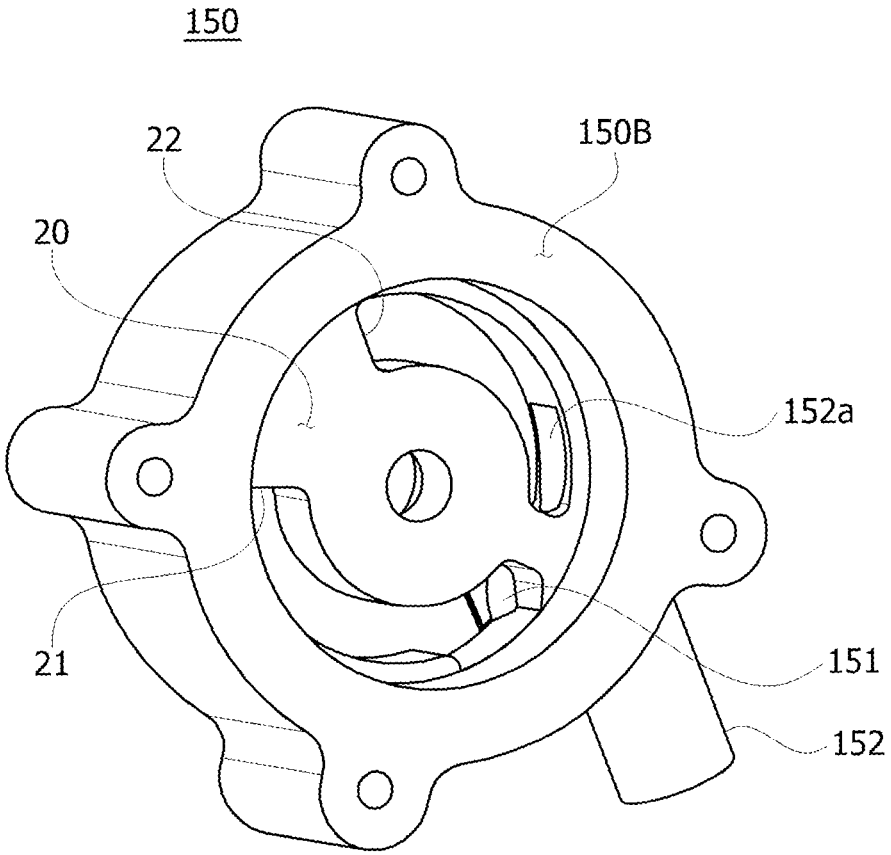
FIG. 7 is a view showing a second-stage outlet channel of a second housing shown in FIG. 6.

FIG. 6 is a view showing a second-stage inlet channel of the second housing and FIG. 7 is a view showing a second-stage outlet channel of the second housing shown in FIG. 6.

Referring to FIG. 6 and FIG. 7, the second pump accommodating part 20 may be formed in the second housing 150. Also, the second housing 150 may be coupled to the first housing 140 to cover the first pump accommodating part 10. Specifically, the second pump accommodating part 20 is concavely formed in a front face of the second housing 150. The second pump unit 130 may be inserted into the second pump accommodating part 20. In addition, a second-stage inlet port 21 and a second-stage outlet port 22 may be formed in a bottom face of the second pump accommodating part 20 and separated from each other.

The second-stage outlet port 22 may be connected to a second-stage outlet channel 152. An entrance of the second-stage outlet channel 152 may be formed at an end portion of the second-stage outlet port 22 and an exit of the second-stage outlet channel may be formed in the bottom face of the mounting part 170. Due to the above structure, the oil pumped by the second pump unit 130 may be discharged through the second-stage outlet channel 152.

Meanwhile, a rear face of the second housing 150 acts as a cover covering the first pump accommodating part 10 of the first housing 140. Also, the first-stage inlet port 11 and the first-stage outlet port 12 may be formed in the rear face of the second housing 150 and may be separated from each other. At this time, a second-stage inlet channel 151 may be formed at the first-stage inlet port 11. The second-stage inlet channel 151 passes from a rear face 150A to a front face 150B of the second housing 150 to cause the first-stage outlet port 12 and the second-stage inlet port 21 to communicate with each other. Therefore, the oil pumped in the first pump unit 120 may be conveyed to the second pomp unit 130 via the second-stage inlet channel 151. Meanwhile, a shaft hole 153 into which the shaft 113 is fitted is formed at a center of the second housing 150, and a bearing 180 may be mounted in the shaft hole 153. The bearing 180 may rotatably support the shaft 1130. Since the bearing 180 is mounted in the second housing 150 as described above to enable the second housing to more structurally stably support the shaft 113, it is possible to prevent the shaft 113 from being bent and to prevent a vibration and noise from be generated.

Figure 8:
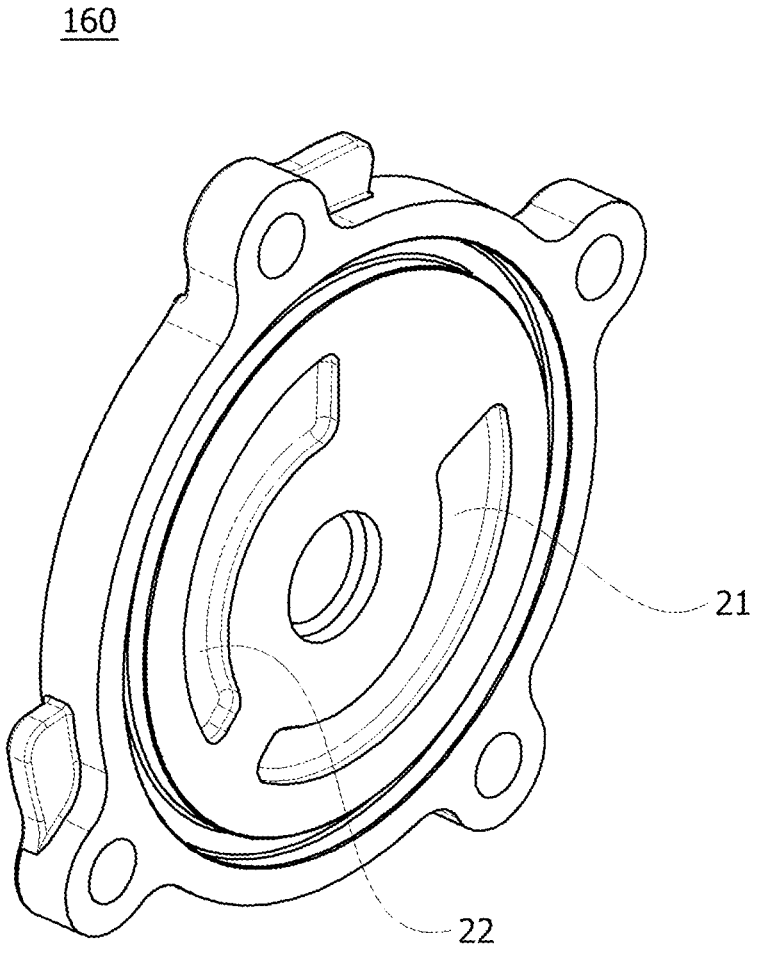
FIG. 8 is a view showing a second-stage inlet port and a second-stage outlet port formed on a cover unit.

FIG. 8 is a view showing the second-stage inlet port and the second-stage outlet port formed on the cover unit.

Referring to FIG. 8, the cover unit 160 may be coupled to the front face 150B of the second housing 150 to cover the second pump accommodating part 20. The second-stage inlet port 21 and the second-stage outlet port 22 may be concavely in an inner side face of the cover unit 160 and may be separated from each other. A sealing member 190 may be disposed between the cover unit 160 and the second housing 150.

Meanwhile, a coupling member such as a bolt B (see FIG. 2) passes through the cover unit 160 and the second housing 150 and is then coupled to the first housing 140. Therefore, it is possible to couple the cover unit 160 and the second housing 150 to the first housing 140.

According to one embodiment of the present disclosure, as the first pump unit and the second pump unit are coupled using one shaft as a coaxial axis, the first pump unit is arranged in the first housing in which the motor housing and the pump housing are integrally formed with each other, and the second housing in which the second pump unit is disposed is coupled to the first housing, a preferred effect in that the number of components is reduced, a tolerance of component is reduced, a manufacturing cost is reduced, and a configuration is simplified, thereby providing a compact electric pump when the two-stage pump is manufactured.

In the above, the electric pump according to one preferred embodiment of the present disclosure was described in detail with reference to the accompanying drawings.

The above detail description merely describes an exemplary technical spirit of the present disclosure, those skilled in the art will appreciate that various alterations, modifications, and substitutions are possible, without departing from the intrinsic characteristic of the disclosure. Therefore, the preferred embodiments disclosed in the present disclosure and the accompanying drawings are not intended to limit, but to describe the spirit of the present disclosure, and the scope of the technical spirit of present disclosure is not limited to the above embodiment and the accompanying drawings. The protective scope of the present disclosure should be interpreted by below claims, and all the technical spirits which are equivalent to claims should be interpreted as being included in the scope of the right of the present disclosure.

Thus, the present disclosure is invented in order to solve the aforementioned problem, an object of the present disclosure is to provide a two-stage electric pump composed of a high-pressure pump and a low-pressure pump, which can simplifies a structure and reduce a manufacturing cost.

The task to be achieved by the present disclosure is not limited to the above mentioned task, and another task which is not mentioned herein may be understood by one skilled in the art from the below description.

According to an aspect of the present disclosure, there is provided an electric pump including a motor unit including a stator, a rotor core disposed inside the stator and a shaft coupled to the rotor core; a first pump unit and a second pump unit which are coupled using the shaft as a coaxial axis; a first housing in which a motor housing receiving the motor unit and a pump housing including a first pump accommodating part are integrally formed, the first pump unit being inserted in the first pump accommodating part; a second housing coupled to the first housing to cover the first pump accommodating part and including a second pump accommodating part in which the second pump unit is inserted; and a cover unit coupled to the second housing to cover the second pump accommodating part.

Preferably, each of the first pump unit and the second pump unit may include an internal rotor coupled to the shaft and having an external lob formed thereon and an external rotor disposed outside the internal rotor and having an internal lobe formed to be engaged with the external lob.

Preferably, the second pump accommodating part may be formed on a front face of the second housing and a rear face of the second housing may cover the first pump accommodating part Preferably, the first pump accommodating part and the rear face of the second housing may have a first-stage inlet port and a first-stage outlet port formed such that the first-stage inlet port and the first-stage outlet port may be separated from each other.

Preferably, the second pump accommodating part and an inner face of the cover unit may have a second-stage inlet port and a second-stage outlet port formed such that the second-stage inlet port and the second-stage outlet port may be separated from each other.

Preferably, the first housing may include a first-stage inlet channel connected to the first-stage inlet port and a first-stage outlet channel connected to the first-stage outlet port, and the second housing may include a second-stage inlet channel passing through the front face and the rear face to cause the first-stage outlet port and the second-stage inlet port to communicate with each other and a second-stage outlet channel connected to the second-stage outlet port.

Preferably, the second housing may have a shaft hole, through which the shaft passes, formed at a center thereof and a bearing may be inserted in the shaft hole to rotatably support the shaft.

Preferably, the electric pump may include a sealing member disposed between the cover unit and the second housing.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric pump comprising:

a motor unit including a stator, a rotor core disposed inside the stator, and a shaft coupled to the rotor core;

a first pump unit and a second pump unit which are coupled using the shaft as a coaxial axis;

a first housing in which a motor housing receiving the motor unit and a pump housing including a first pump accommodating part are integrally formed, the first pump unit being inserted in the first pump accommodating part;

a second housing coupled to the first housing to cover the first pump accommodating part and including a second pump accommodating part in which the second pump unit is inserted; and a cover unit coupled to the second housing to cover the second pump accommodating part, wherein each of the first pump unit and the second pump unit comprises an internal rotor coupled to the shaft and having an external lob formed thereon and an external rotor disposed outside the internal rotor and having an internal lobe formed to be engaged with the external lob, wherein the second pump accommodating part is formed on a front face of the second housing and a rear face of the second housing covers the first pump accommodating part, wherein the first pump accommodating part and the rear face of the second housing have a first-stage inlet port and a first-stage outlet port formed such that the first-stage inlet port and the first-stage outlet port are separated from each other, and wherein the second pump accommodating part and an inner face of the cover unit have a second-stage inlet port and a second-stage outlet port formed such that the second-stage inlet port and the second-stage outlet port are separated from each other, wherein the first housing includes a first-stage inlet channel connected to the first-stage inlet port and a first-stage outlet channel connected to the first-stage outlet port, and the second housing includes a second-stage inlet channel passing through the front face and the rear face to cause the first-stage outlet port and the second-stage inlet port to communicate with each other and a second-stage outlet channel connected to the second-stage outlet port.

2. The electric pump of claim 1, wherein a mounting part is integrally formed with the motor housing and the pump housing.

3. The electric pump of claim 2, wherein an entrance of the first-stage outlet channel is formed at an end portion of the first-stage outlet port and an exit of the first-stage outlet channel is formed in a bottom face of the mounting part.

4. The electric pump of claim 2, wherein an entrance of the second-stage outlet channel is formed at an end portion of the second-stage outlet port and an exit of the second-stage outlet channel is formed in a bottom face of the mounting part.

* * * * *